US010601112B2

(12) United States Patent
Zhang et al.

(10) Patent No.: US 10,601,112 B2
(45) Date of Patent: Mar. 24, 2020

(54) ANTENNA SYSTEM AND MOBILE TERMINAL

(71) Applicant: AAC Technologies Pte. Ltd., Singapore (SG)

(72) Inventors: Liwan Zhang, Shenzhen (CN); Kai Dong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 131 days.

(21) Appl. No.: 15/828,627

(22) Filed: Dec. 1, 2017

(65) Prior Publication Data

US 2018/0375194 A1 Dec. 27, 2018

(30) Foreign Application Priority Data

Jun. 22, 2017 (CN) ..... 2017 1 0482128

(51) Int. Cl.

| | |
|---|---|
| ***H01Q 1/24*** | (2006.01) |
| ***H01Q 5/335*** | (2015.01) |
| ***H01Q 21/28*** | (2006.01) |
| ***H01Q 9/42*** | (2006.01) |
| ***H01Q 1/38*** | (2006.01) |
| ***H01Q 1/48*** | (2006.01) |

(Continued)

(52) U.S. Cl.

CPC ..... *H01Q 1/243* (2013.01); *H01Q 1/38* (2013.01); *H01Q 1/48* (2013.01); *H01Q 5/335* (2015.01); *H01Q 5/35* (2015.01); *H01Q 5/40* (2015.01); *H01Q 5/50* (2015.01); *H01Q 9/42* (2013.01); *H01Q 13/10* (2013.01); *H01Q 1/521* (2013.01); *H01Q 21/28* (2013.01)

(58) Field of Classification Search

CPC ..... H01Q 1/24; H01Q 1/241; H01Q 1/242; H01Q 1/243; H01Q 1/38; H01Q 1/48; H01Q 1/521; H01Q 5/314; H01Q 5/328; H01Q 5/335; H01Q 5/35; H01Q 5/40; H01Q 5/50; H01Q 21/28; H01Q 9/42; H01Q 13/10

See application file for complete search history.

(56) References Cited

U.S. PATENT DOCUMENTS 8,798,554 B2 * 8/2014 Darnell ..... H01Q 1/243 455/77
9,692,099 B2 * 6/2017 Kato ..... H01P 1/213

(Continued)

*Primary Examiner* — Daniel Munoz
*Assistant Examiner* — Patrick R Holecek
(74) *Attorney, Agent, or Firm* — IPro, PLLC; Na Xu

(57) ABSTRACT

An antenna system and a mobile terminal, the antenna system includes a metal shell, a system ground, a mainboard and an antenna unit, the system ground is connected with the metal shell; the mainboard is provided with a mainboard ground connected with the system ground, a main circuit and a matching network, the matching network includes a first and second matching element; the main circuit includes a first radio frequency source, a first antenna terminal, a second antenna terminal and a second radio frequency source which are successively connected in series, and at least one matching network is provided between any adjacent two of them, the antenna unit is connected with the mainboard through the first and/or the second antenna terminal, so that the antenna unit is coupled with the top frame or the bottom frame to form a first antenna, a second antenna and a third antenna.

8 Claims, 8 Drawing Sheets

(51) Int. Cl.

| | |
|---|---|
| ***H01Q 13/10*** | (2006.01) |
| ***H01Q 5/35*** | (2015.01) |
| ***H01Q 5/50*** | (2015.01) |
| ***H01Q 5/40*** | (2015.01) |
| *H01Q 1/52* | (2006.01) |

(56) References Cited

U.S. PATENT DOCUMENTS

| | | | | |
|---|---|---|---|---|
| 9,871,286 | B2 * | 1/2018 | Kang | H01Q 5/35 |
| 2007/0222697 | A1 * | 9/2007 | Caimi | H01Q 1/243 343/861 |
| 2017/0170562 | A1 * | 6/2017 | Lee | H01Q 1/243 |

* cited by examiner

ANTENNA SYSTEM AND MOBILE TERMINAL

TECHNICAL FIELD

The present disclosure relates to the field of communication technologies and, particularly, to an antenna system and a mobile terminal.

BACKGROUND

At present, a rear cover made of metal has become a popular structure for a number of brands of cellphones, and an N-type metal rear cover is a recently prevalent three-section structure. Generally, a cellphone having the N-type three-section metal rear cover can form a GPS/WIFI antenna system by coupling its frame with different antenna units. Basically, a mainboard of the antenna system is merely provided with a grounding point and a feeding point for connecting with external components, so that during a debugging process of the antenna system, the mainboard can be conveniently connected with the antenna system. However, since internal components of different cellphones may have different arrangements, or profiles of the N-type three-section metal frames of different cellphones may also be different, a required structural design of the antenna and radio frequency network design of the system mainboard will be different accordingly. Therefore, during debugging, it is necessary to try a variety of implementation manners of the antenna structure. Moreover, in some implementing manners, only one frequency network source is required, some may require two frequency network sources, some may require a plurality of grounding points, and some may require to use a tuning switch. As a result, it is needed to create various mainboards to achieve antenna debugging through different combinations, which will inevitably increase manufacture cost.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

REFERENCE SIGNS

- 10—metal shell;
  - 11—top frame;
    - 111—first end;
    - 112—second end;
  - 12—bottom frame;
  - 13—middle back cover;
  - 14—notch;
  - 15—connecting rib;
- 20—middle frame;
- 30—mainboard;
  - 31—main circuit;
    - 311—first radio frequency source;
    - 312—first antenna terminal;
    - 313—second antenna terminal;
    - 314—second radio frequency source;
  - 32—matching network;
    - 321—first matching element;
    - 322—second matching element;
  - 33—mainboard ground;
- 40—antenna unit;
  - 41—first metal wiring;
  - 42—second metal wiring;
    - 421—transition section;
    - 422—opposite section;
  - 43—third metal wiring;
    - 431—first section;
    - 432—second section;
  - 44—fourth metal wiring;
  - 45—fifth metal wiring;
  - 46—sixth metal wiring;
- 50—camera.

The drawings herein are incorporated into and constitute a part of the present specification, which show the embodiments of the present disclosure and illustrate the principles of the present disclosure together with the specification.

DESCRIPTION OF EMBODIMENTS

The present disclosure will be further illustrated with reference to the accompanying drawings and embodiments.

Figure 1:
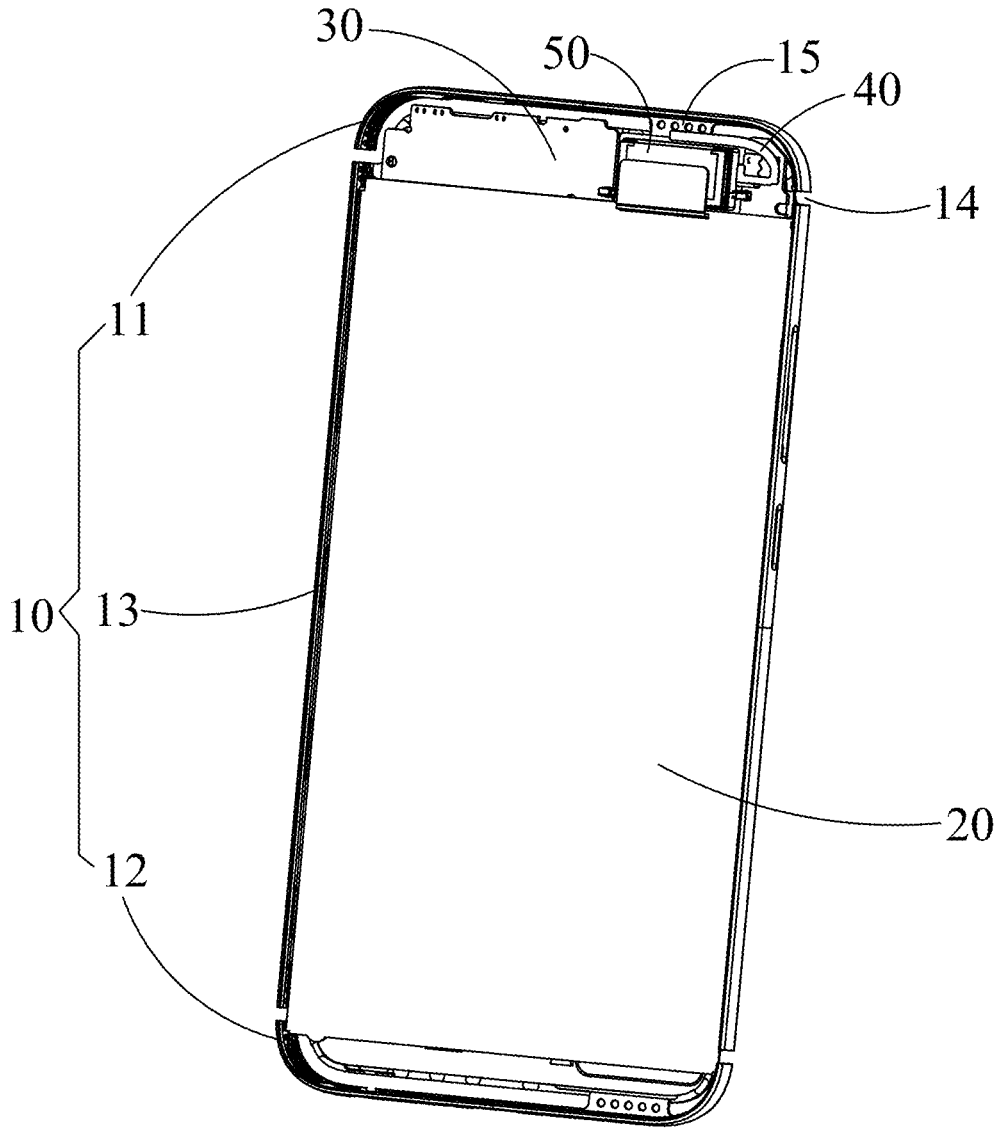
FIG. 1 is a structural schematic view of an antenna system in accordance with an exemplary embodiment provided by the present disclosure.
Figure 2:
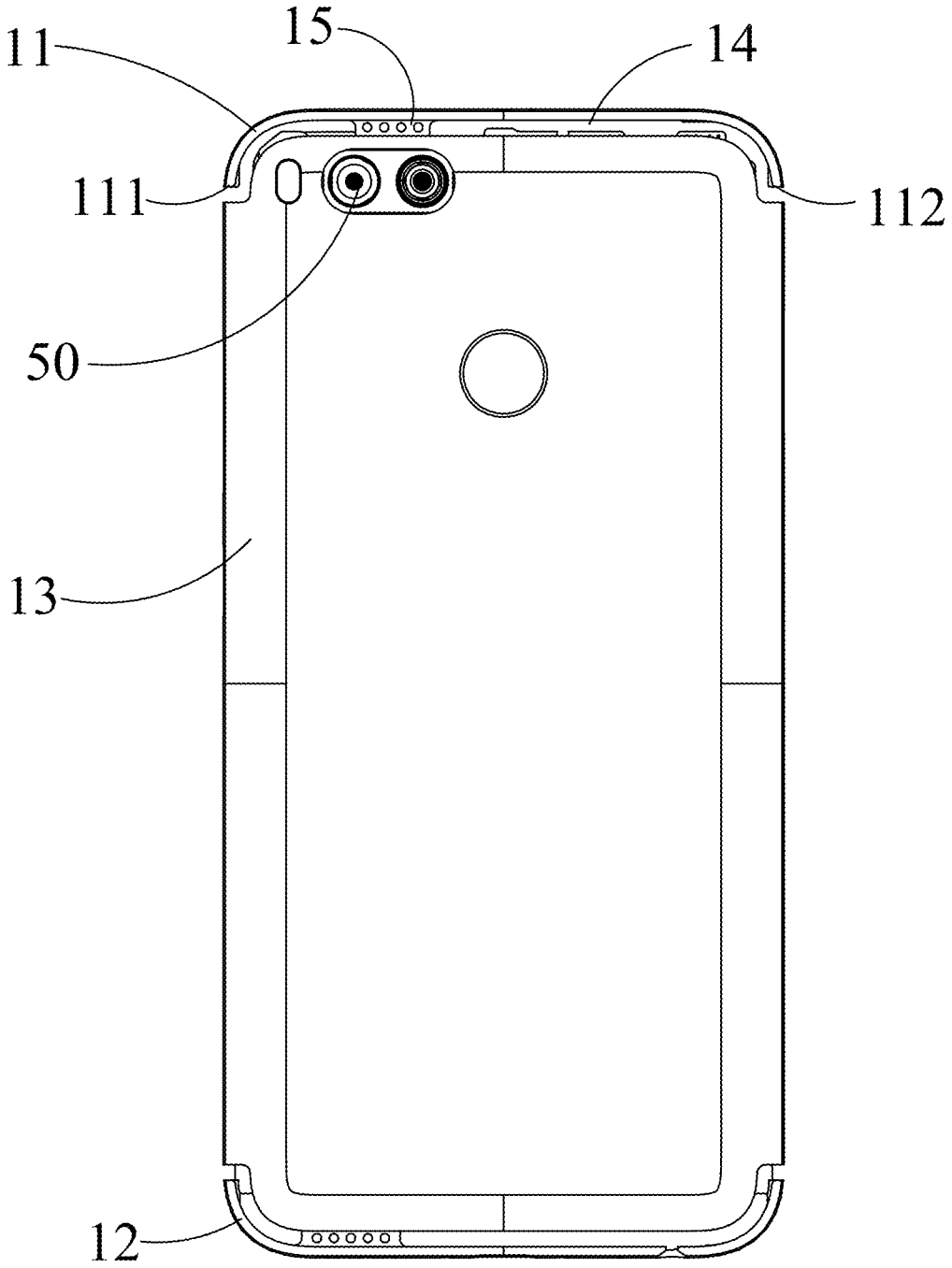
FIG. 2 is a rear view of an antenna system in accordance with an exemplary embodiment provided by the present disclosure.
Figure 3:
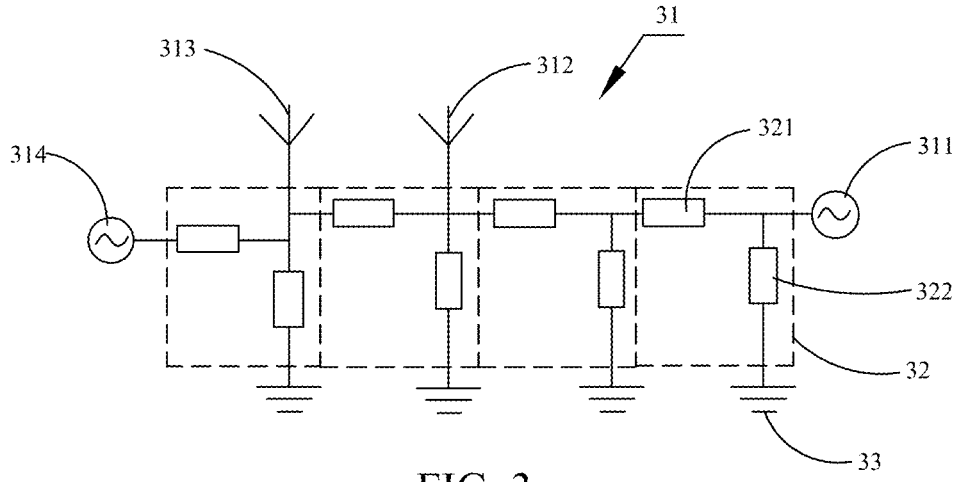
FIG. 3 is a structural schematic view of a main circuit in an antenna system in accordance with an exemplary embodiment provided by the present disclosure.

As shown in FIGS. 1-3, an exemplary embodiment of the present disclosure provides an antenna system, which can be used in a mobile terminal, e.g. a cellphone. The antenna system includes a metal shell 10, a system ground (not shown in the figures), a mainboard 30 and an antenna unit 40. The metal shell 10 includes a top frame 11, a bottom frame 12 and a middle back cover 13. A notch 14 is provided respectively between the middle back cover 13 and the top frame 11 and between the middle back cover 13 and the bottom frame 12. The top frame 11 and the bottom frame 12 are connected with the middle back cover 13 through a connecting rib 15. As shown in FIG. 2, the metal shell 10 is provided with two notches 14, and the two notches 14 divide the metal shell 10 into the top frame 11, the middle back cover 13 and the bottom frame 12. The connecting rib 15 is provided at the notch 14 so as to connect the top frame 11 with the middle back cover 13 and connect the bottom frame 12 with the middle back cover 13. The system ground is connected with the metal shell 10, so that the metal shell 10 is connected with the ground, thereby providing a stable system ground for the whole system.

The mainboard 30 is provided with a mainboard ground 33 connected with the system ground and a main circuit 31. The main circuit 31 includes a matching network 32. The matching network 32 includes a first matching element 321 and a second matching element 322. As shown in FIG. 3, the main circuit 31 also includes a first radio frequency source 311, a first antenna terminal 312, a second antenna terminal 313 and a second radio frequency source 314 which are successively connected in series. At least one matching network 32 is provided between any adjacent two of the first radio frequency source 311, the first antenna terminal 312, the second antenna terminal 313 and the second radio frequency source 314, that is, the matching network 32 is respectively provided between the first radio frequency source 311 and the first antenna terminal 312, between the first antenna terminal 312 and the second antenna terminal 313, and between the second antenna terminal 313 and the second radio frequency source 314. The number of the matching network 32 at each of the above-described locations does not influence each other (independent from each other), i.e., the number of the matching network 32 between the first radio frequency source 311 and the first antenna terminal 312, the number of the matching network 32 between the first antenna terminal 312 and the second antenna terminal 313, and the number of the matching network 32 between the second antenna terminal 313 and the second radio frequency source 314 can be respectively equal to or different from each other, or it is also possible that two of them are equal but different from the other one.

The first matching element 321 of the matching network 32 is connected in series in the main circuit 31, and one end of the second matching element 322 is connected with the main circuit 31, while the other end of the second matching element 322 is connected with the mainboard ground 33.

The antenna unit 40 is connected with the mainboard 30 through the first antenna terminal 312 and/or the second antenna terminal 313, so that the antenna unit 40 is coupled with the top frame 11 or the bottom frame 12 to form a first antenna, a second antenna and a third antenna. It shall be understood that, the antenna unit 40 can be connected with only one or both of the first antenna terminal 312 and the second antenna terminal 313. However, no matter in which way the antenna unit 40 is connected with the mainboard 30, the antenna unit 40 can be adjacent to the top frame 11 or the bottom frame 12. When the antenna unit 40 is provided at the top frame 11, the antenna unit 40 is coupled with the top frame 11 to form the first antenna, the second antenna and the third antenna. When the antenna unit 40 is provided at the bottom frame 12, the antenna unit 40 is coupled with the bottom frame 12 to form the first antenna. The present disclosure will be illustrated in detail by taking a coupling between the antenna unit 40 and the top frame 11 as an example.

In the above-described structure, the first radio frequency source 311, the second radio frequency source 314, the first antenna terminal 312, the second antenna terminal 313 and a plurality of matching networks 32 are provided on the mainboard 30. During debugging of different antenna units 40, the antenna unit 40 can be connected with the first antenna terminal 312 and/or the second antenna terminal 313, so that operation of the first radio frequency source 311 and the second radio frequency source 314 can be controlled through combinations of different matching elements in the matching network 32, thereby achieving one mainboard 30 being adapted to debugging processes of a plurality of antenna units 40. Therefore, with this structure, it is possible to reduce manufacture cost as much as possible, and there is no need to replace the mainboard 30 during debugging, which facilitates the debugging process.

One end of the top frame 11 is closer to the antenna unit 40 than the other end of the top frame 11, i.e., the top frame 11 includes two ends, respectively a first end 111 and a second end 112, and the first end 111 is closer to the antenna unit 40 than the second end 112.

The first antenna is a GPS antenna with a working frequency range of 1550~1620 MHz. The second antenna is a WIFI 2.4 antenna with a working frequency range of 2412~2482 MHz. The third antenna is a WIFI 5G antenna with a working frequency range of 5150~5850 MHz.

If the number of the matching network 32 between the first radio frequency source 311 and the first antenna terminal 312, the number of the matching network 32 between the first antenna terminal 312 and the second antenna terminal 313, and the number of the matching network 32 between the second antenna terminal 313 and the second radio frequency source 314 are too large, wiring of the mainboard 30 will be more difficult. Therefore, optionally, as shown in FIG. 3, two matching networks 32 are provided between the first antenna terminal 312 and the first radio frequency source 311, and one matching network 32 is provided between the first antenna terminal 312 and the second antenna terminal 313, and one matching network 32 is provided between the second antenna terminal 313 and the second radio frequency source 314, thereby guaranteeing requirements of debugging of various antenna units 40, as well as decreasing design difficulty of the mainboard 30.

Specifically, in the matching network 32, the first matching element 321 and/or the second matching element 322 may be one of a capacitance, an inductance, a resistance and a switch. The capacitance can be an adjustable capacitance or a capacitance having a constant value; the inductance can be an adjustable inductance or an inductance having a constant value; the resistance can be an adjustable resistance or a resistance having a constant value; the switch is a conventional switch can merely be switched on or switched off. In such a way, different connection manners of the antenna unit 40 can be achieved by the main circuit 31 through combinations of different matching elements, thereby forming different antennas.

A First Embodiment

In the matching network 32 between the first antenna terminal 312 and the first radio frequency source 311, one first matching element 321 is a capacitance, and each other first matching element 321 is a resistance of 0Ω; each second matching element 322 is in a disconnected state, i.e., each second matching element 322 is a switch, and the switch is in a disconnected state.

In the matching network 32 between the first antenna terminal 312 and the second antenna terminal 313, each first matching element 321 and each second matching element 322 are respectively one of a capacitance, an inductance, a resistance of 0Ω, or in a disconnected state. That is, the first matching element 321 may be a capacitance, an inductance, a resistance of 0Ω, or a switch (in a disconnected state); the second matching element 322 may be a capacitance, an inductance, a resistance of 0Ω, or a switch (in a disconnected state).

In the matching network 32 between the second antenna terminal 313 and the second radio frequency source 314, each first matching element 321 is in a disconnected state, and each second matching element 322 is in a disconnected state. That is, both the first matching element 321 and the second matching element 322 of the matching network 32 are switches, and the switches are in a disconnected state, so as to disconnect the second radio frequency source 314 from the antenna unit 40.

Figure 4:
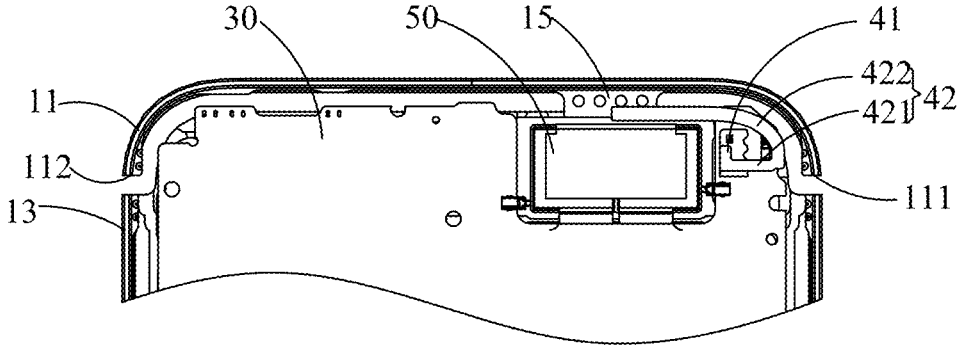
FIG. 4 is a structural schematic view of an antenna unit in accordance with the first embodiment.

As shown in FIG. 4, the antenna unit 40 includes a first metal wiring 41 connected with the first antenna terminal 312 and a second metal wiring 42 connected with the first metal wiring 41. The first metal wiring 41 is perpendicular to the top frame 11, and the second metal wiring 42 is at least partially facing and spaced from the top frame 11. Generally, the second metal wiring 42 includes a transition section 421 and an opposite section 422 which is opposite to the top frame 11. One end of the transition section 421 is connected with the first metal wiring 41, and the other end of the transition section 421 is connected with the opposite section 422. Optionally, the transition section 421 is parallel to the top frame 11, an outer profile of the opposite section 422 can be consistent with that of the top frame 11, so that the antenna unit 40 can be coupled with the top frame 11, thereby forming the first antenna, the second antenna and the third antenna, i.e., forming a closed monopole coupling antenna.

Figure 5:
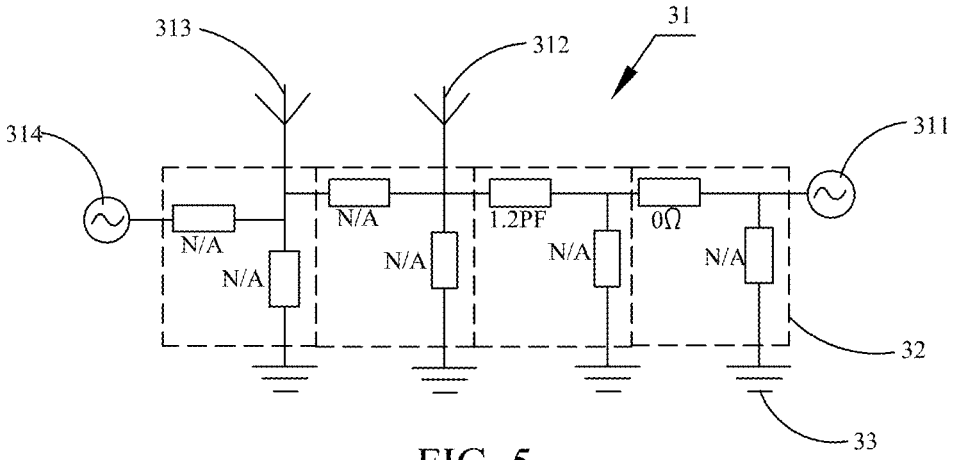
FIG. 5 is a structural schematic view of a main circuit in accordance with a first embodiment provided by the present disclosure.

Specifically, in the main circuit 31 shown in FIG. 3, the setting of each matching network 32 is shown in FIG. 5, in two matching networks 32 between the first radio frequency source 311 and the first antenna terminal 312, the first matching element 321 of one matching network 32 is a resistance of 0Ω, and the first matching element 321 of the other matching network 32 is a capacitance having a capacitance value of 1.2 PF or other values, which can be selected according to debugging requirements. Both the second matching elements 322 of two matching networks 32 are switches, and both the switches are in a disconnected state. An expression N/A (Not Available) indicates the disconnected state, which is the same in the following embodiments. The first matching element 321 and the second matching element 322 of the matching network 32 between the first antenna terminal 312 and the second antenna terminal 313 are respectively switches, and the switches are in a disconnected state, so that the first antenna terminal 312 is not conducted with the second antenna terminal 313 on the mainboard 30. The first matching element 321 and the second matching element 322 of the matching network 32 between the second antenna terminal 313 and the second radio frequency source 314 are respectively switches, and the switches are in a disconnected state. In the present embodiment, one end of the first metal wiring 41 connected with the first antenna terminal 312 is a feeding point, i.e., the antenna unit 40 is connected with the mainboard 30 through the capacitance so as to achieve feeding.

In the present embodiment, a main radiator of the first antenna is: a portion of the top frame 11 from one end of the top frame 11 closer to the antenna unit 40 (i.e., the first end 111) to the connecting rib 15 along a circumferential direction of the top frame 11, i.e., a portion on the top frame 11 between the first end 111 and the connecting rib 15, and a resonance path length of this portion is approximately a quarter of a resonance wavelength of the GPS.

A main radiator of the second antenna is the second metal wiring 42, and a resonance path length of this portion is approximately a quarter of a resonance wavelength of the WIFI 2.4.

Main radiators of the third antenna include the first metal wiring 41, and the portion of the top frame 11 from one end of the top frame 11 close to the antenna unit 40 (i.e., the first end 111) to the connecting rib 15 along the circumferential direction of the top frame 11, that is, the first metal wiring 41 generates a resonance of 5 GHz and its resonance path length is approximately a quarter of a resonance wavelength of WIFI 5G, and a resonance is approximately at 5200 MHz. Moreover, a third harmonic of the portion of the top frame 11 between the first end 111 and the connecting rib 15 is in a frequency band of 5 GHz, and a resonance is approximately at 5700 MHz.

Figure 6:
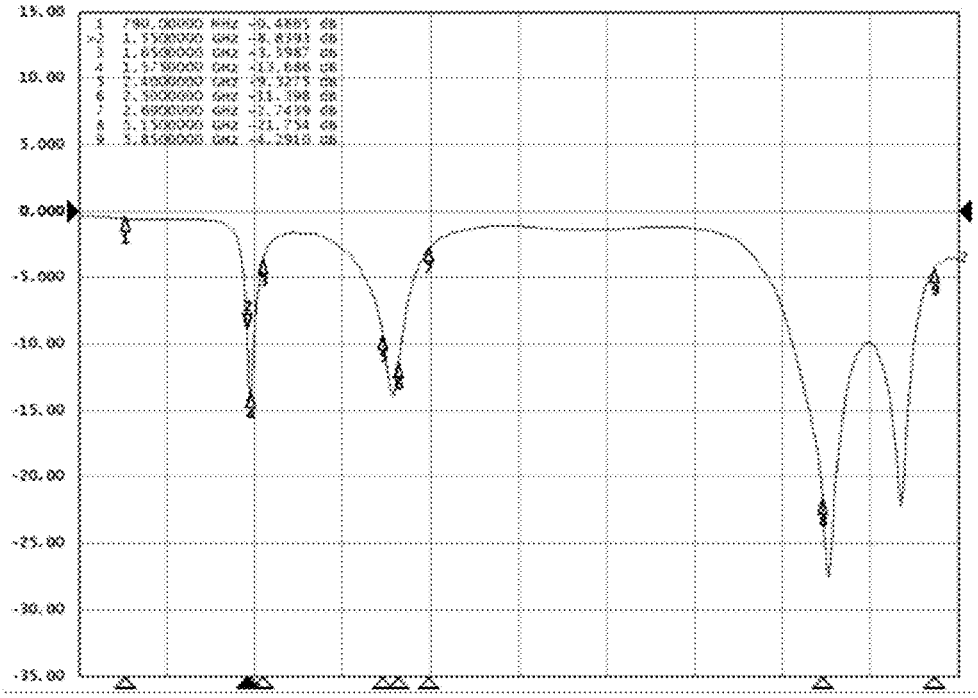
FIG. 6 is a graph showing return loss of the first embodiment.
Figure 7:
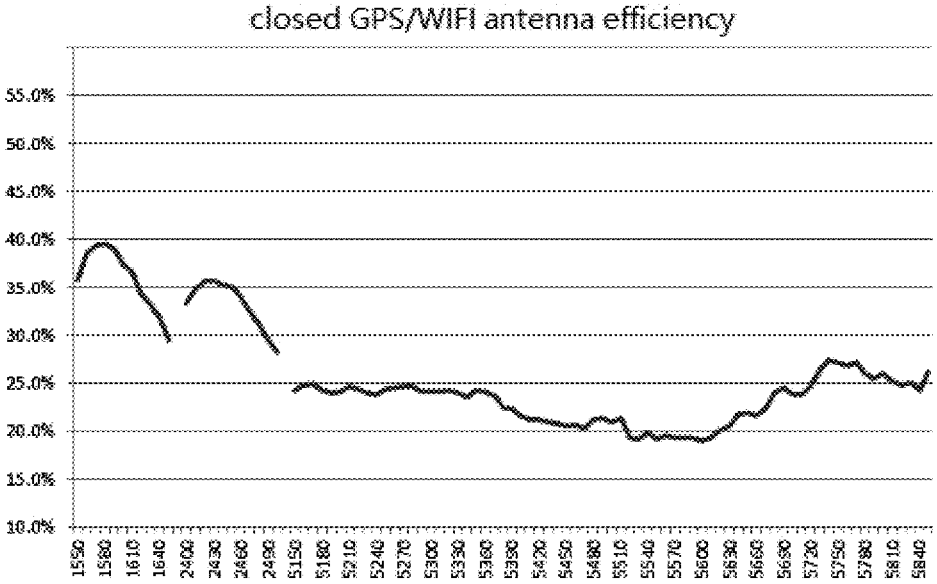
FIG. 7 is a graph showing radiation efficiency of the first embodiment.

A return loss graph of the antenna system with such a structure is shown in FIG. 6, and a radiation efficiency graph is shown in FIG. 7.

A Second Embodiment

In the matching network 32 between the first antenna terminal 312 and the first radio frequency source 311, one first matching element 321 is a capacitance, and each other first matching element 321 is a resistance of 0Ω; one second matching element 322 is an inductance, and each other second matching element 322 is in a disconnected state. i.e., each other second matching element 322 is a switch, and the switch is in a disconnected state, the first antenna terminal 312 is connected with the first radio frequency source 311 through a capacitance connected in series, and the first antenna terminal 312 is electrically connected with the mainboard ground 33 through the inductance.

In the matching network 32 between the first antenna terminal 312 and the second antenna terminal 313, each first matching element 321 is one of a capacitance, an inductance, a resistance of 0Ω and in a disconnected state, and each second matching element 322 is in a disconnected state, i.e., each first matching element 321 is a switch, and the switch is in a disconnected state, so that the first antenna terminal 312 is not directly conducted with the second antenna terminal 313 on the mainboard 30.

In the matching network 32 between the second antenna terminal 313 and the second radio frequency source 314, each first matching element 321 is in a disconnected state, i.e., each first matching element 321 is a switch, and each switch is in a disconnected state. One second matching element 322, which is closest to the first antenna terminal 312, is a resistance of 0Ω, and each other second matching element 322 can be a resistance of 0Ω, a switch, a capacitance, or an inductance, so as to guarantee the second antenna terminal 313 being connected to the ground. In the main circuit 31, the first antenna terminal 312 is not directly conducted with the second antenna terminal 313 on the mainboard 30 but is conducted with the second antenna terminal 313 through a connecting antenna unit, so as to form a loop with the antenna unit.

Figure 8:
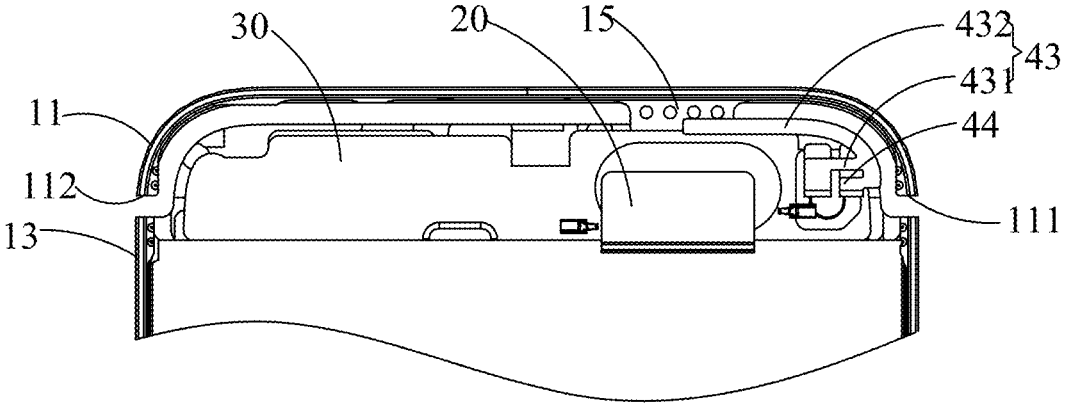
FIG. 8 is a structural schematic view of an antenna unit in the second embodiment.

As shown in FIG. 8, the antenna unit 40 includes a third metal wiring 43 connected with the first antenna terminal 312 and a fourth metal wiring 44 connected with the second antenna terminal 313. The third metal wiring 43 is connected with and partially facing and spaced from the fourth metal wiring 44. Moreover, the third metal wiring 43 is at least partially facing and spaced from the top frame 11, it shall be understood that, the third metal wiring 43 includes a first section 431 and a second section 432. The first section 431 is facing and spaced the fourth metal wiring 44, and both the first section 431 and the fourth metal wiring 44 can be formed as a L-shaped structure, each L-shaped structure includes a first portion and a second portion perpendicular to the first portion. The first portion is perpendicular to the top frame 11, and the second portion is parallel to the top frame 11. The first portion of the third metal wiring 43 is connected with the first antenna terminal 312, and a feeding point is arranged at an end of the first portion of the third metal wiring 43. An end of the first portion of the fourth metal wiring 44 is connected with the second antenna terminal 313, and the second portion of the fourth metal wiring 44 is connected with the second section 432, a grounding point of the antenna unit 40 is arranged at an end of the first portion of the fourth metal wiring 44. Optionally, at the antenna unit 40, compared with the first portion of the third metal wiring 43, the first portion of the fourth metal wiring 44 is closer to an outer side of the metal shell 10. An outer profile of the second section 432 is consistent with that of the top frame 11, so that the antenna unit 40 can be coupled with the top frame 11, thereby forming the first antenna, the second antenna and the third antenna, i.e., a closed PIFA coupling antenna.

Figure 9:
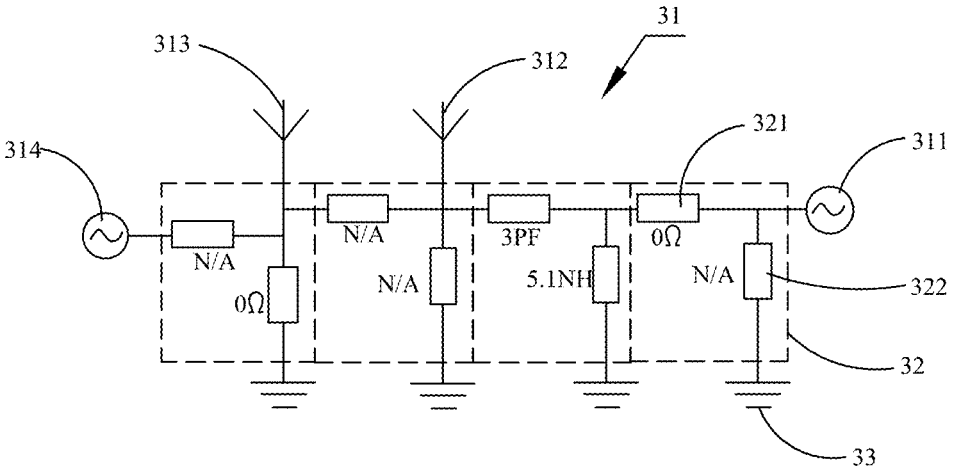
FIG. 9 is a structural schematic view of a main circuit in accordance with a second embodiment provided by the present disclosure.

Specifically, in the main circuit 31 shown in FIG. 3, the setting of each matching network 32 is shown in FIG. 9. In two matching networks 32 between the first radio frequency source 311 and the first antenna terminal 312, one first matching element 321 is a resistance of 0Ω, and the other first matching element 321 is a capacitance, a capacitance value of the capacitance can be 3 PF, obviously, it may also be other values, which can be selected according to debugging requirements. One second matching element 322 is an inductance having an inductance value of 5.1 nH or other values, each other second matching element 322 is a switch, and both the switches are in a disconnected state, i.e., the third metal wiring 43 is connected with the first radio frequency source 311 through the capacitance, so as to achieve feeding. Moreover, the third metal wiring 43 is further connected with the mainboard ground 33 through the inductance arranged in parallel, so as to be connected with the ground. The first matching element 321 of the matching network 32 between the first antenna terminal 312 and the second antenna terminal 313 is in a disconnected state, so as to disconnect the first antenna terminal 312 from the second antenna terminal 313, and then the third metal wiring 43 is not conducted with the fourth metal wiring 44 through the mainboard 30. Each first matching element 321 of the matching network 32 between the second antenna terminal 313 and the second radio frequency source 314 is in a disconnected state. The second matching element 322 is a resistance of 0Ω, so that the fourth metal wiring 44 can be connected with the mainboard ground 33 through the second antenna terminal 313. In the present embodiment, one end of the third metal wiring 43 connected with the first antenna terminal 312 is a feeding point, i.e., the feeding point of the antenna unit 40 is connected with the first antenna terminal 312, and the grounding point is connected with the second antenna terminal 313.

In the present embodiment, a main radiator of the first antenna is: a portion of the top frame 11 from one end of the top frame 11 close to the antenna unit 40 (i.e., the first end 111) to the connecting rib 15 along a circumferential direction of the top frame 11, i.e., a portion on the top frame 11 between the first end 111 and the connecting rib 15, and a resonance path length of this portion is approximately a quarter of a resonance wavelength of the GPS.

A main radiator of the second antenna is a connection structure formed by the third metal wiring 43 and the fourth metal wiring 44 connected with the third metal wiring 43, and a resonance path length of this portion is approximately a quarter of a resonance wavelength of the WIFI 2.4.

Main radiators of the third antenna include a gap between the third metal wiring 43 and the fourth metal wiring 44, and the portion of the top frame 11 from one end of the top frame 11 close to the antenna unit 40 (i.e., the first end 111) to the connecting rib 15 along the circumferential direction of the top frame 11. A resonance of 5 GHz is generated from a gap path between the fourth metal wiring 44 and the first section 431 of the third metal wiring 43, and its resonance path length is approximately a quarter of a resonance wavelength of the WIFI 5G, and a resonance is approximately at 5200 MHz. Moreover, a third harmonic of the portion of the top frame 11 between the first end 111 and the connecting rib 15 is in frequency band of 5 GHz, and a resonance is approximately at 5700 MHz.

Figure 10:
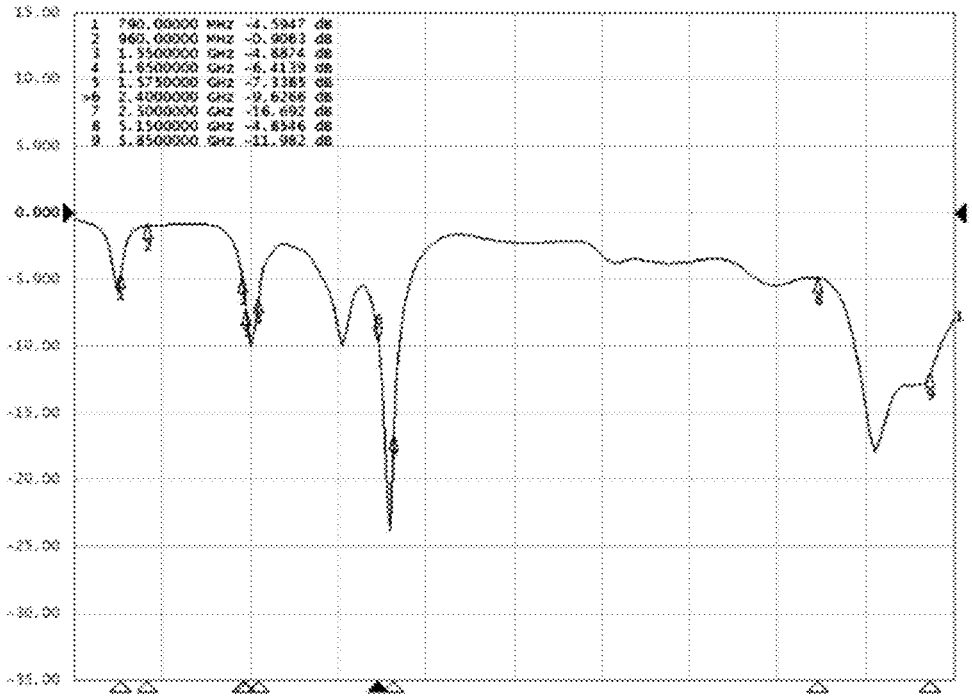
FIG. 10 is a graph showing return loss of the second embodiment.
Figure 11:
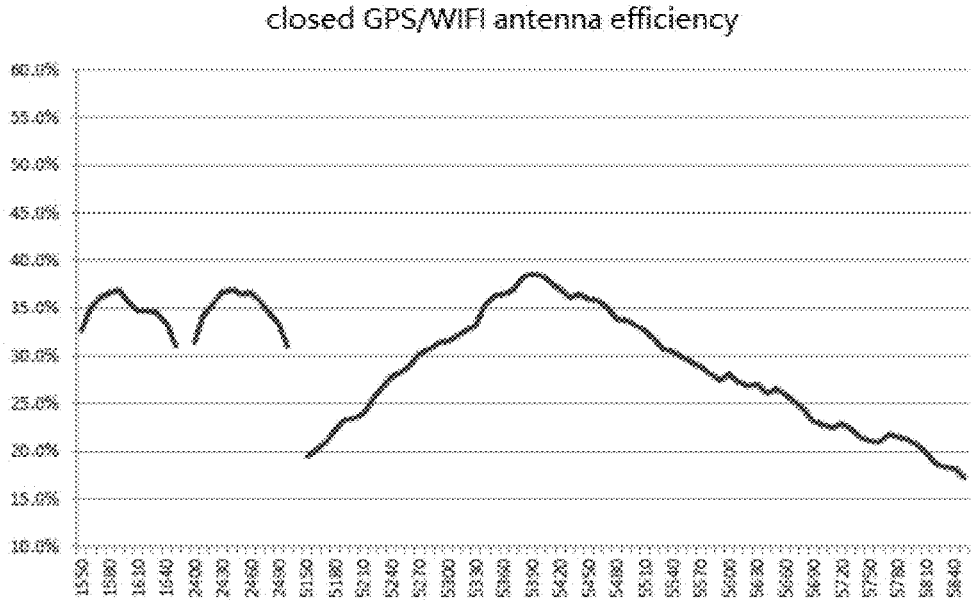
FIG. 11 is a graph showing radiation efficiency of the second embodiment.

A return loss graph of the antenna system with such a structure is shown in FIG. 10, and a radiation efficiency graph is shown in FIG. 11.

A Third Embodiment

In the matching network 32 between the first antenna terminal 312 and the first radio frequency source 311, one first matching element 321 is a capacitance, and each other first matching element 321 is a resistance of 0Ω; each second matching element 322 is in a disconnected state, i.e., each second matching element 322 is a switch, and the switch is in a disconnected state.

In the matching network 32 between the first antenna terminal 312 and the second antenna terminal 313, each first matching element 321 is in a disconnected state and each second matching element 322 is in a disconnected state, i.e., both the first matching element 321 and the second matching element 322 of the matching network 32 are switches, and the switches are in a disconnected state, so that the first antenna terminal 312 is not conducted with the second antenna terminal 313 on the mainboard 30.

In the matching network 32 between the second antenna terminal 313 and the second radio frequency source 314, each first matching element 321 is a resistance of 0Ω; at least one second matching element 322 is a capacitance and each other second matching element 322 is in a disconnected state, so that the second antenna terminal 313 can be directly conducted with the second radio frequency source 314 on the mainboard 30. Moreover, the second antenna terminal 313 is connected with the mainboard ground 33 through the capacitance.

Figure 12:
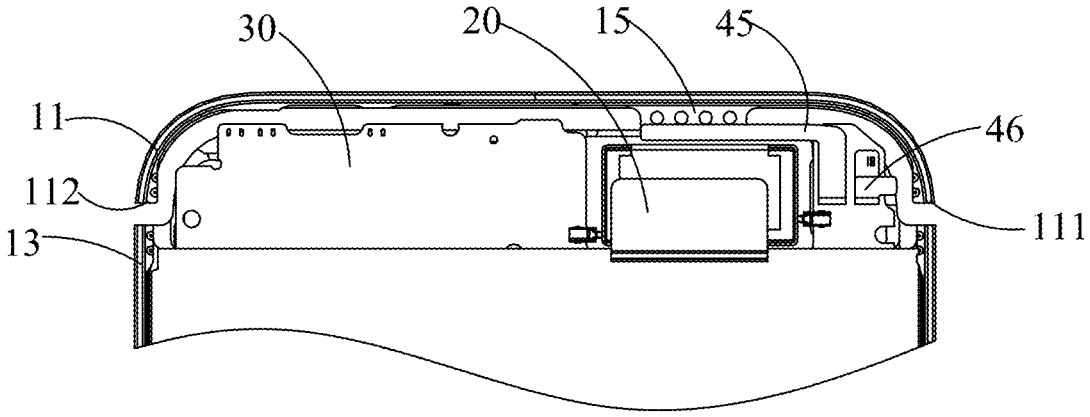
FIG. 12 is a structural schematic view of an antenna unit in the third embodiment.

As shown in FIG. 12, the antenna unit 40 includes a fifth metal wiring 45 connected with the first antenna terminal 312 and a sixth metal wiring 46 connected with the second antenna terminal 313. The fifth metal wiring 45 is connected with and partially facing and spaced from the sixth metal wiring 46, and the fifth metal wiring 45 is at least partially spaced from the top frame 11. Specifically, both the fifth metal wiring 45 and the sixth metal wiring 46 can be formed as a L-shaped structure, each including a first portion and a second portion perpendicular to the first portion. The first portion of the fifth metal wiring 45 is opposite to the first portion of the sixth metal wiring 46, and the first portion of the fifth metal wiring 45 and the first portion of the sixth metal wiring 46 can be parallel to each other and both perpendicular to the top frame 11. An extending direction of the second portion of the fifth metal wiring 45 faces away from an extending direction of the second portion of the sixth metal wiring 46, and both the second portion of the fifth metal wiring 45 and the second portion of the sixth metal wiring 46 can be parallel to the top frame 11. Optionally, compared with the first portion of the fifth metal wiring 45, the first portion of the sixth metal wiring 46 is closer to the first end 111. Further, compared with the second portion of the sixth metal wiring 46, the second portion of the fifth metal wiring 45 is closer to the top frame 11. An end of the first portion of the fifth metal wiring 45 is connected with the first antenna terminal 312, so as to serve as a first feeding point, and an end of the second portion of the sixth metal wiring 46 is connected with the second antenna terminal 313, so as to serve as a second feeding point, so that the antenna unit 40 is coupled with the top frame 11, thereby forming the first antenna, the second antenna and the third antenna, i.e., a dual-antenna system of GPS, 2.4 GHz and 5 GHz.

Figure 13:
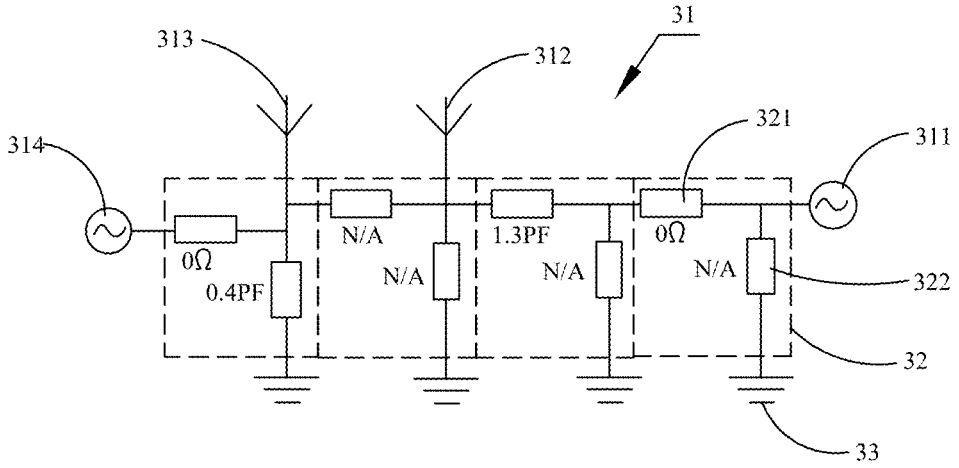
FIG. 13 is a structural schematic view of a main circuit in accordance with a third embodiment provided by the present disclosure.

Specifically, in the main circuit 31 shown in FIG. 3, the setting of each matching network 32 is shown in FIG. 13. In two matching networks 32 between the first radio frequency source 311 and the first antenna terminal 312, one first matching element 321 is a resistance of 0Ω, and the other first matching element 321 is a capacitance, a capacitance value of the capacitance can be 1.3 PF. Obviously, it may also be other values. Both the second matching elements 322 of the two matching networks 32 are switches in a disconnected state. Both the first matching element 321 and the second matching element 322 of the matching network 32 between the first antenna terminal 312 and the second antenna terminal 313 are switches in a disconnected state, so that the first antenna terminal 312 is not conducted with the second antenna terminal 313 on the mainboard 30. The first matching element 321 of the matching network 32 between the second antenna terminal 313 and the second radio frequency source 314 a resistance of 0Ω, the second matching element 322 is a capacitance having a capacitance value of 0.4 PF or other values. In the present embodiment, one end of the fifth metal wiring 45 connected with the first antenna terminal 312 is a first feeding point, i.e., the first radio frequency source 311 feeds the fifth metal wiring 45 through the capacitance. The sixth metal wiring 46 is connected with the second radio frequency source 314, i.e., the second radio frequency source 314 feeds the sixth metal wiring 46, one end of the sixth metal wiring 46 connected with the second antenna terminal 313 is a second feeding point.

In the present embodiment, a main radiator of the first antenna is: a portion of the top frame 11 from one end of the top frame 11 close to the antenna unit 40 (i.e., the first end 111) to the connecting rib 15 along a circumferential direction of the top frame 11, i.e., a portion on the top frame 11 between the first end 111 and the connecting rib 15, and a resonance path length of this portion is approximately a quarter of a resonance wavelength of the GPS.

A main radiator of the second antenna is the fifth metal wiring 45, and a resonance path length of this portion is approximately a quarter of a resonance wavelength of WIFI 2.4.

Main radiators of the third antenna include the sixth metal wiring 46, the fifth metal wiring 45, and the portion of the top frame 11 from one end of the top frame 11 close to the antenna unit 40 (i.e., the first end 111) to the connecting rib 15 along the circumferential direction of the top frame 11. Specifically, the sixth metal wiring 46 dominated by the second radio frequency source 314 generates a resonance of 5 GHz and its resonance path is approximately a quarter of a wavelength of WIFI 5G, and the resonance is approximately at 5200 MHz. When the fifth metal wiring 45 is formed as a L-shaped structure, an equivalent path is lengthened due to bending of the first portion and the second portion. Therefore, the fifth metal wiring 45 further generates a resonance of 5 GHz, which is a second frequency multiplication of WIFI 2.4G, the resonance is at 5200 MHz, which is controlled by the first radio frequency source 311. Meanwhile, a third harmonic of the portion of the top frame 11 between the first end 111 and the connecting rib 15 is in a frequency band of 5 GHz, and a resonance is approximately at 5850 MHz, which belongs to a parasitic resonance controlled by the first radio frequency source 311. The first radio frequency source 311 and the second radio frequency source 314 cooperate to make the third antenna 5 GHz frequency band achieve a MIMO communication property with multi-input and multi-output, thereby improving data utilization.

Figure 14:
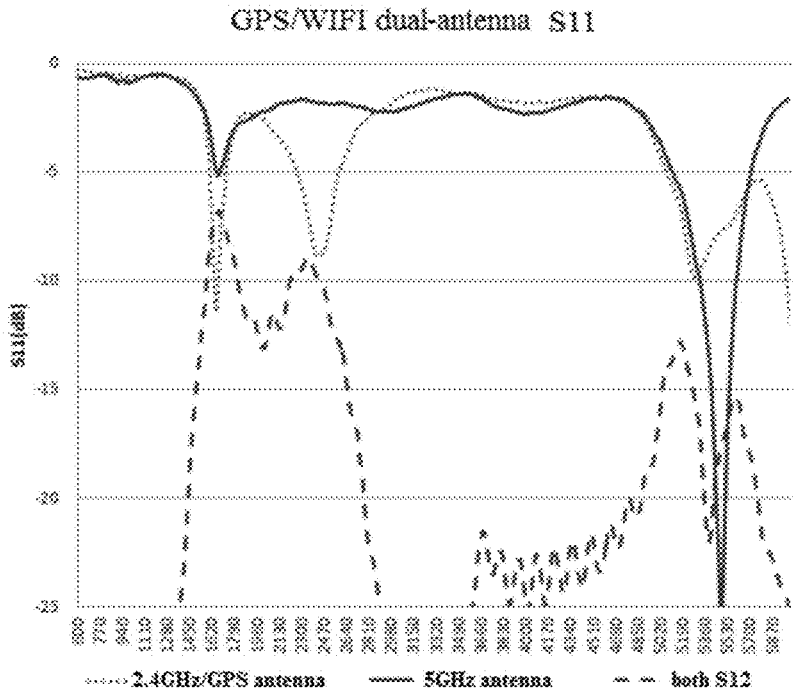
FIG. 14 is a graph showing return loss of the third embodiment.
Figure 15:
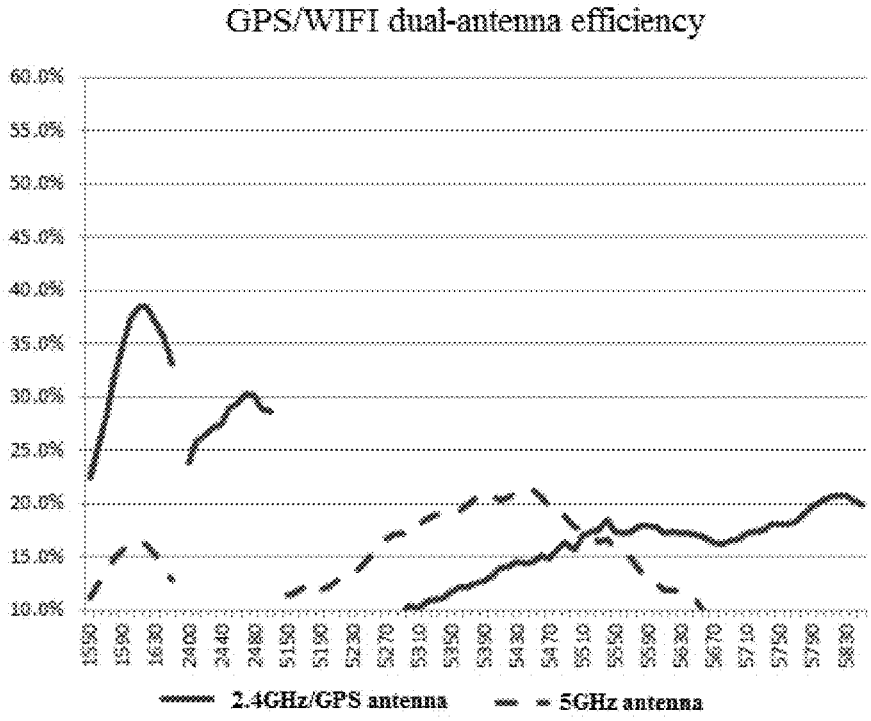
FIG. 15 is a graph showing radiation efficiency of the third embodiment.

A return loss graph of the antenna system with such a structure is shown in FIG. 14, and a radiation efficiency graph is shown in FIG. 15.

It should be noted that, in the above-described embodiments, in practice, when the switch is in a disconnected state, it is possible to directly suspend both ends connected with the switch, and the switch will actually not be connected.

In the above-described embodiments, each metal wiring of the antenna unit 40, such as the first metal wiring 41, the second metal wiring 42, the third metal wiring 43, the fourth metal wiring 44, the fifth metal wiring 45 and the sixth metal wiring 46 may be a flexible printed circuit (Flexible Printed Circuit, FPC) board, and may also be produced by a laser direct structuring (Laser Direct Structuring, LDS) technique.

Optionally, in the above-described embodiments, a connecting manner between the first antenna terminal 312 and the antenna unit 40 and between the second antenna terminal 313 and the antenna unit 40 may be welding, clamping, or connecting by a spring pin, the connecting by a spring pin is preferred, so as to increase connection reliability between the antenna unit 40 and the mainboard 30.

In general, the antenna system further includes a middle frame 20 configured for supporting the mainboard 30, the middle frame 20 is arranged in the metal shell 10 and connected with the system ground, so that the whole system ground can be more stable.

It is understood that, a headroom region is provided between the mainboard 30 and the metal shell 10, along a direction perpendicular to the middle back cover 13, a projection of the antenna unit 40 is located in a projection of the headroom region.

Obviously, the above structure integrates an implementation of a conventional coupling three-in-one antenna, and meets structure requirements of the antenna units 40 of different forms at the same time through a compatible matching network 32, so as to achieve verification of the solutions with a maximum possibility during debugging process. It should be understood that, by adopting structures in the present disclosure, not only the antenna units 40 described in the first embodiment, the second embodiment, and the third embodiment can be debugged, but also the antenna units 40 having other structures can be debugged.

In addition, the present disclosure further provides a mobile terminal, including the antenna system as described in any one of the above-described embodiments. Generally, the mobile terminal further includes a camera 50, and the antenna unit is usually arranged close to the camera, in order to prevent an interference of the camera 50 against the antenna system, the camera 50 is further electrically connected with the system ground. Specifically, as shown in FIG. 1, an edge of the camera 50 is connected with the mainboard ground 33, and a bottom frame of the camera 50 is connected with the middle frame 20, and the connection manner can be a direct connection or a connection via a metal member or a spring pin. It should be understood that, the middle frame 20 can be provided between the mainboard 30 and a screen of the mobile terminal.

The above description only shows optional embodiments of the present disclosure and is not intended to limit the present disclosure. Various replacements and modifications may be made by those skilled in the art. Any modifications, equivalent replacements, improvements and the like made within the spirit and principles of the present disclosure should be included in the protection scope of the present disclosure.

What is claimed is:

1. An antenna system, comprising:

a metal shell comprising a top frame, a bottom frame and a middle back cover; a notch is defined respectively between the middle back cover and the top frame and between the middle back cover and the bottom frame, the top frame is connected with the middle back cover by a connecting rib;

a system ground connected with the metal shell;

a mainboard comprising a mainboard ground connected with the system ground and a main circuit;

an antenna unit adjacent to the top frame or bottom frame;

the mainboard circuit comprises a first radio frequency source, a first antenna terminal, a second antenna terminal, a second radio frequency source and a few matching networks, at least one of the matching networks is provided between the first radio frequency source and the first antenna terminal, at least another one of the matching networks is provided between the second radio frequency source and the second antenna terminal, at least a further one of the matching networks is provided between the first antenna terminal and the second antenna terminal;

the antenna unit is connected with the mainboard by the first antenna terminal and/or the second antenna terminal, so that the antenna unit is coupled with the top frame or the bottom frame to form a first antenna, a second antenna and a third antenna;

each one of the matching networks comprises a first matching element and a second matching element; the first matching element of the matching network is connected in series in the main circuit, one end of the second matching element is connected with the main circuit while the other end of the second matching element is connected with the mainboard ground;

each first matching element and each second matching element can be chosen from one of a capacitance, an inductance, a resistance and a switch to form different connection manners of the antenna unit, wherein the first radio frequency resource, the first antenna terminal, the second antenna terminal and the second radio frequency source are successively arranged, two matching networks are provided in series between the first antenna terminal and the first radio frequency source; another one matching network is arranged between the first antenna terminal and the second antenna terminal; a further one matching network is arranged between the second antenna terminal and the second radio frequency source, and both of the first antenna terminal and the second antenna terminal are directly connected to the mainboard ground through a second matching element.

2. The antenna system as described in claim 1, wherein in the matching network between the first radio frequency resource and the first antenna terminal, one first matching element is a capacitance, and the other first matching element is a resistance of 0Ω; each second matching element is a switch in a disconnected state;

in the matching network between the first antenna terminal and the second antenna terminal, the first matching element is a switch in a disconnected state; and the second matching element is a switch in a disconnected state;

in the matching network between the second antenna terminal and the second radio frequency source, the first matching element is a switch in a disconnected state, and the second matching element is a switch in a disconnected state;

the antenna unit comprises a first metal wiring connected with the first antenna terminal and a second metal wiring connected with the first metal wiring, the first metal wiring is perpendicular to the top frame; the second metal wiring is at least partially facing and spaced from the top frame, so that the antenna unit is coupled with the top frame to form the first antenna, the second antenna and the third antenna.

3. The antenna system as described in claim 2, wherein one end of the top frame is closer to the antenna unit than the other end of the top frame, a main radiator of the first antenna is a portion of the top frame, and the portion of the top frame is from the end of the top frame closer to the antenna unit to the connecting rib along a circumferential direction of the top frame; a main radiator of the second antenna is the second metal wiring; main radiators of the third antenna include the first metal wiring, and the portion of the top frame from the end of the top frame closer to the antenna unit to the connecting rib along the circumferential direction of the top frame.

4. The antenna system as described in claim 1, wherein in the matching network between the first antenna terminal and the first radio frequency source, one first matching element is a capacitance, and the other first matching element is a resistance of 0Ω; one second matching element is an inductance, and the other second matching element is a switch in a disconnected state;

in the matching network between the first antenna terminal and the second antenna terminal, the first matching element is a switch in a disconnected state, and the second matching element is a switch in a disconnected state;

in the matching network between the second antenna terminal and the second radio frequency source, the first matching element is a switch in a disconnected state, the second matching element is a resistance of 0Ω;

the antenna unit comprises a third metal wiring connected with the first antenna terminal and a fourth metal wiring connected with the second antenna terminal; the third metal wiring is connected with the fourth metal wiring, and the third metal wiring is partially facing and spaced from the fourth metal wiring; the third metal wiring is at least partially facing and spaced from the top frame, so that the antenna unit is coupled with the top frame to form the first antenna, the second antenna and the third antenna.

5. The antenna system as described in claim 4, wherein one end of the top frame is closer to the antenna unit than the other end of the top frame, a main radiator of the first antenna is a portion of the top frame, and the portion of the top frame is from the end of the top frame closer to the antenna unit to the connecting rib along a circumferential direction of the top frame; a main radiator of the second antenna is a connection structure formed by the third metal wiring and the fourth metal wiring connected with the third metal wiring; main radiators of the third antenna include a gap between the third metal wiring and the fourth metal wiring, and the portion of the top frame which is from the end of the top frame closer to the antenna unit to the connecting rib along the circumferential direction of the top frame.

6. The antenna system as described in claim 1, wherein in the matching network between the first antenna terminal and the first radio frequency source, one first matching element is a capacitance, and the other first matching element is a resistance of 0Ω; each second matching element is a switch in a disconnected state;

in the matching network between the first antenna terminal and the second antenna terminal, the first matching element is a switch in a disconnected state, and the second matching element is a switch in a disconnected state;

in the matching network between the second antenna terminal and the second radio frequency source, the first matching element is a resistance of 0Ω; the second matching element is a capacitance;

the antenna unit comprises a fifth metal wiring connected with the first antenna terminal and a sixth metal wiring connected with the second antenna terminal, the fifth metal wiring is connected with the sixth metal wiring, and the fifth metal wiring is partially facing and spaced from the sixth metal wiring; the fifth metal wiring is at least partially facing and spaced from the top frame, so that the antenna unit is coupled with the top frame to form the first antenna, the second antenna and the third antenna.

7. The antenna system as described in claim 6, wherein one end of the top frame is closer to the antenna unit than the other end of the top frame, a main radiator of the first antenna is a portion of the top frame, and the portion of the top frame is from the end of the top frame closer to the antenna unit to the connecting rib along a circumferential direction of the top frame; a main radiator of the second antenna is the fifth metal wiring; main radiators of the third antenna include the sixth metal wiring, the fifth metal wiring, and the portion of the top frame from the end of the top frame closer to the antenna unit to the connecting rib along the circumferential direction of the top frame.

8. A mobile terminal, comprising the antenna system as described in claim 1.

* * * * *